US006557194B1

(12) United States Patent
Jeffries et al.

(10) Patent No.: US 6,557,194 B1
(45) Date of Patent: May 6, 2003

(54) METHOD FOR SECURING BED COVERINGS AND APPARATUS THEREFOR

(76) Inventors: Deidra B. Jeffries, 25408 Via Escovar, Valencia, CA (US) 91355; Sandra B. Brazier, 5445 Lake Lindero Dr., Agoura Hills, CA (US) 91301

( * ) Notice: Subject to any disclaimer, the term of this patent is extended or adjusted under 35 U.S.C. 154(b) by 0 days.

(21) Appl. No.: 10/078,881

(22) Filed: Feb. 19, 2002

Related U.S. Application Data

(63) Continuation-in-part of application No. 09/678,346, filed on Oct. 3, 2000.

(51) Int. Cl.[7] ..... A47C 21/02
(52) U.S. Cl. ..... 5/504.1; 5/498; 24/72.5
(58) Field of Search ..... 5/494, 496, 498, 5/499, 504.1, 658; 24/72.5

(56) References Cited

U.S. PATENT DOCUMENTS

| | | | | | |
|---|---|---|---|---|---|
| 1,950,084 | A | * | 3/1934 | Halsey | 24/72.5 |
| 2,326,399 | A | * | 8/1943 | Shields | 24/72.5 |
| 2,857,643 | A | * | 10/1958 | Tomsic | 24/72.5 |
| 2,979,737 | A | * | 4/1961 | Pierre | 5/498 |
| 3,092,848 | A | * | 6/1963 | Gronvold | 24/72.5 X |
| 3,350,726 | A | * | 11/1967 | Gardner | 5/411 |
| 4,199,831 | A | * | 4/1980 | Muller | 5/498 X |
| 4,466,148 | A | * | 8/1984 | Jones | 5/503.1 |
| 4,782,543 | A | * | 11/1988 | Hutton et al. | 5/658 |
| 4,862,541 | A | * | 9/1989 | Hutton et al. | 5/496 |
| 5,179,743 | A | * | 1/1993 | Lanman | 5/498 |
| 5,815,861 | A | * | 10/1998 | LaGrange et al. | 5/504.1 |
| 6,161,235 | A | * | 12/2000 | Smith et al. | 5/504.1 |
| 2002/0062522 | A1 | * | 5/2002 | Deckert | 5/504.1 |

* cited by examiner

*Primary Examiner*—Robert G. Santos
(74) *Attorney, Agent, or Firm*—Ted Masters

(57) ABSTRACT

A method for attaching a top bed covering to a bed, includes (a) providing a bed having a mattress disposed on top of a box spring, the mattress and box spring having adjacent side walls, (b) providing a top bed covering, (c) providing a device for attaching a bed covering to a bed, the device including:

an elongated member having a first end and an opposite second end;

a connector attached to the first end;

an anchor connected to the second end;

(d) positioning the anchor so that it simultaneously abuts the side walls of both the mattress and the box spring, (e) positioning the elongated member between the mattress and the box spring, and, (f) attaching the connector to the top bed covering.

1. In an alternative embodiment, the anchor has nubbed sides and is placed horizontally between the mattress and the box spring.

4 Claims, 10 Drawing Sheets

METHOD FOR SECURING BED COVERINGS AND APPARATUS THEREFOR

CROSS REFERENCE TO RELATED APPLICATION

This application is a Continuation-In-Part of application Ser. No. 09/678,346, filed Oct. 03, 2000, which is included herein in its entirety by reference.

TECHNICAL FIELD

The present invention pertains generally to beds and bed coverings, and in particular to a method and apparatus for fastening a bed covering such as a sheet or blanket so that the bed coverings will not pull out from under the mattress.

BACKGROUND ART

Inventions relating to bed coverings and means for securing same are well known in the art. For example, U.S. Pat. No. 4,891,856 shows a grasping system for use on contoured sheets to keep sheets tucked and tight under mattress. The system comprises two independent terry elastic straps having a nylon insert clip attached to each end and an adjustable slide on each front end of the straps. Both straps crisscross along bottom surface portion of the mattress.

U.S. Pat. No. 5,033,139 illustrates a device to secure the top sheet of bedding from being accidentally pulled out at the foot of the bed. An elongated piece of plastic material is provided for placement between the mattress and the box springs of a bed, wherein the end of the tucked-in top sheet of the bed is in contact with one side of the elongated piece of material, and the other side of the elongated piece is in contact with the box springs. The top sheet securing device is constructed of materials which have a high coefficient of static friction such that the weight of the mattress pressing down upon the tucked-in top sheet is sufficient to provide compression of the plastic material between the top sheet and lower box springs that the top sheet is held in position against the unintentional or accidental pulling out. The top sheet securing device may be alternately made of a thin sheet of vinyl plastic or a thickness of open or closed cell low density polyurethane foam, or a combination of vinyl plastic and polyurethane foam.

U.S. Pat. No. 5,072,470 discloses a device for holding any number or combination of bedclothes in a fixed position on a bed which comprises three component parts all positioned entirely under the uppermost cushioned structure of the bed: a) an anchor member having a plurality of cooperable fastening means disposed generally at peripheral points on it, the fastening means counter poised against one another, b) a plurality of elasticized retaining members having length adjusting mechanism and cooperable fastening means to those on the anchoring member, and c) a plurality of clamps having pivotally connected gripping segments, a closure forcing element and cooperably insertable associated independent coupling elements, said clamps connected to the retaining members. Any number of bedclothes, at any point adjacent to the lower edge of the uppermost cushioned structure, are wrapped around an associated independent coupling element and the associated independent coupling element and bedclothes are then inserted into the clamps. The bedclothes are then tucked under the uppermost cushioned structure of the bed and the elasticized retaining hand is then fastened to the anchoring member the cooperable fastening means. The bedclothes are fastened to the device at opposite sides of the bed and are so held in place by the device through opposing counterpoised force.

U.S. Pat. No. 6,185,766 comprises a bed covering anchor having a pair of adjustable length crossing support straps to allow attachment to the area of the corners of a variety of sizes of bed covering placed on bed mattresses. Elastic straps are engaged at the ends of the crossing straps and have a grasping device at one or both ends of each elastic strap to grasp the covering and provide a retracting force to keep the covering taut on the mattress. One or more lateral support straps may also be attached to the cover to keep the longitudinal edges of the covering taut at the points of attachment.

U.S. Pat. No. 6,295,670 describes a bed covering retention apparatus comprising a planar anchor plate having a proximal portion and a distal portion, an upper surface and a lower surface, a first and a second anchor point at the proximal end of the anchor plate to which first and second elastic bands are removably connected. The first and second elastic bands have a proximal end and distal end and extend from the anchor points along the bottom surface of the anchor plate until each emerges upwardly through respective apertures to the top surface of the anchor plate. The bands further include releasable jaws having an adjustable opening and adjustable tension so that the jaws will clamp securely to sheets and covers of varying thicknesses. The elastic bands are of differing lengths, one being suited to clamping to an innermost bed covering and the other for clamping to coverings above the innermost covering.

DISCLOSURE OF INVENTION

The present invention is directed to a method and device for securing bed coverings, and specifically to a method and device which connects top or bottom bed coverings, such as sheets, so that the both bed coverings will not pull out from under the mattress. The device is installed between the mattress and the box spring, and comprises an elongated member such as a strap, having an anchor at one end, and a connector at the other end.

Prior art inventions require that the strap attach to the sheet or other bed covering at both ends of the strap. With the present invention, once the anchor is in place, an easy, one-time-only event, attachment is required at only at one end to secure the bed covering in place. This permits ease in changing the sheets preventing potential back injuries, saving time and energy.

With prior art inventions, when changing bed sheets, the entire strap has to be repositioned to be effective. This requires lifting a heavy mattress enough to position the strap in the center of the bed at both ends of the mattress. After the present invention is placed the first and only time so that the anchor is centered between the mattress and the box spring, no mattress lifting is required to attach the strap to the middle of the top sheet for optimal positioning/and value. The strap is merely pulled to the side of the bed until it dangles sufficiently to attach to the middle of the top sheet. Then the user simply slides the top sheet until it is centered and positioned correctly.

Prior art inventions require attachment by a connector at both ends of the strap. While the tension of the strap is pulling inward to produce the tension to keep the sheets tucked, the user has to slide the connector in the opposite direction to slide the sheet over the connector and unto the loop. The present invention permits attaching the sheet into the connector with no tension whatsoever. The sheet is attached as it dangles at the side of the mattress. When the top sheet is attached to the connector in place, the user simply pulls and slides the sheet along the foot of the mattress until it is centered and tucked under the top mattress.

OTHER ADVANTAGES

The present invention is easily secured to and prevents the top sheet and blanket from becoming untucked. The present invention permits attachment with the same ease as making the bed with the same risk of injury as making the bed conventionally. The present invention minimizes the prospect of injury because it eliminates the need to remake the bed daily or more often depending on one's bed-making or changing schedule. Adults and those with back pain are assisted by an invention which permits easy bed-making because all that is needed is to pull and smooth the sheets and blankets, not recenter and re-tuck sheets and blankets. Additionally, the present invention permits easy bed-making by children which assists the parents in this housekeeping task, teaches responsibility, and creates self-sufficiency in even the youngest children.

In accordance with a preferred embodiment of the invention, a method for attaching a top bed covering to a bed, includes (a) providing a bed having a mattress disposed on top of a box spring, the mattress and box spring having adjacent vertical side walls, (b) providing a top bed covering, (c) providing a device for attaching a bed covering to a bed, the device including:

an elongated member having a first end and an opposite second end;

a connector attached to the first end;

an anchor connected to the second end;

(d) positioning the anchor so that it simultaneously abuts the side walls of both the mattress and the box spring, (e) positioning the elongated member between the mattress and the box spring, and, (f) attaching the connector to the top bed covering at the opposite end of the bed from the anchor.

In another preferred embodiment of the invention, two devices are placed in adjacent opposing parallel relationship on the underside of the mattress to hold the bottom bed covering, such as a fitted sheet, in place on the mattress.

In another preferred embodiment of the invention, the anchor has nubbed sides and is placed in a horizontal orientation between the mattress and the box spring. The nubbed sides captively abut the mattress and the box spring and hold the anchor in place.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
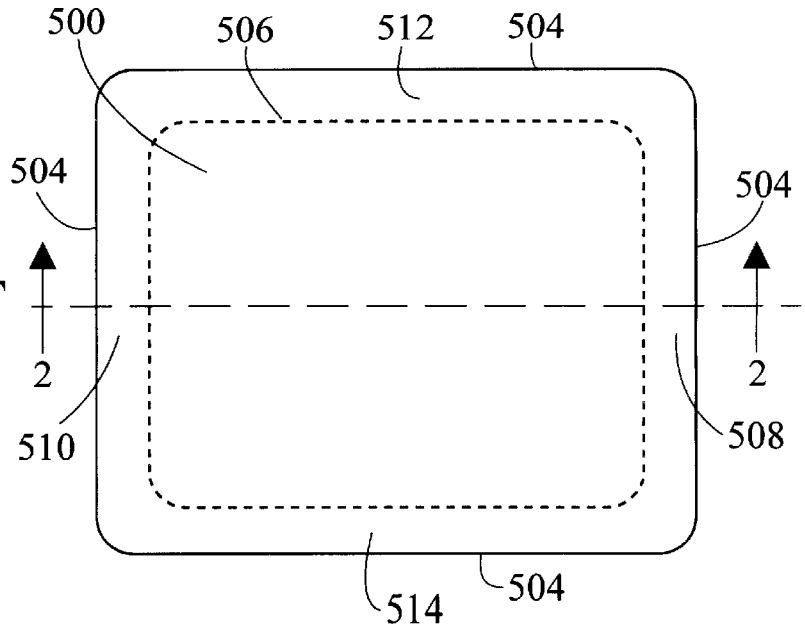
Fig. 1 PRIOR ART
FIG. 1 is a top plan view of a bed comprising a mattress residing on top of a box spring.
Figure 2:
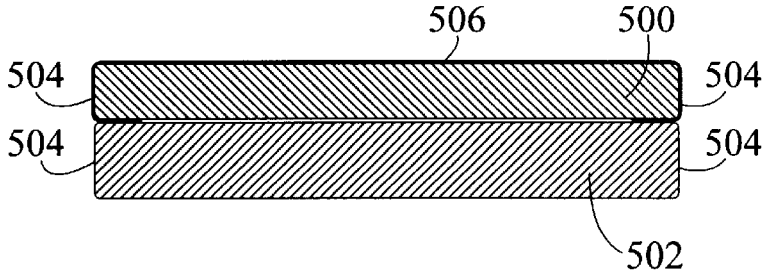
Fig. 2 PRIOR ART
FIG. 2 is cross sectional view along the line 2—2 of FIG. 1.

Referring initially to FIGS. 1 and 2, there are illustrated top plan and cross sectional views respectively of a prior art bed comprising a mattress 500 residing on top of a box spring 502. Mattress 500 and box spring 502 having four sets of adjacent vertical side walls 504. A bottom bed cover 506, such as a fitted sheet, is fitted around mattress 500 in the conventional manner with the edges of the bottom bed covering 506 pulled around the edges of the mattress 500. The bed has a head portion 508 and an opposite foot portion 510, and a right side 512 and an opposite left side 514. The bottom bed covering 506 could also be a flat sheet which is tucked under mattress 500. The illustrated bed is rectangular, however it may be appreciated that other shapes such as circular are also possible.

Figure 3:
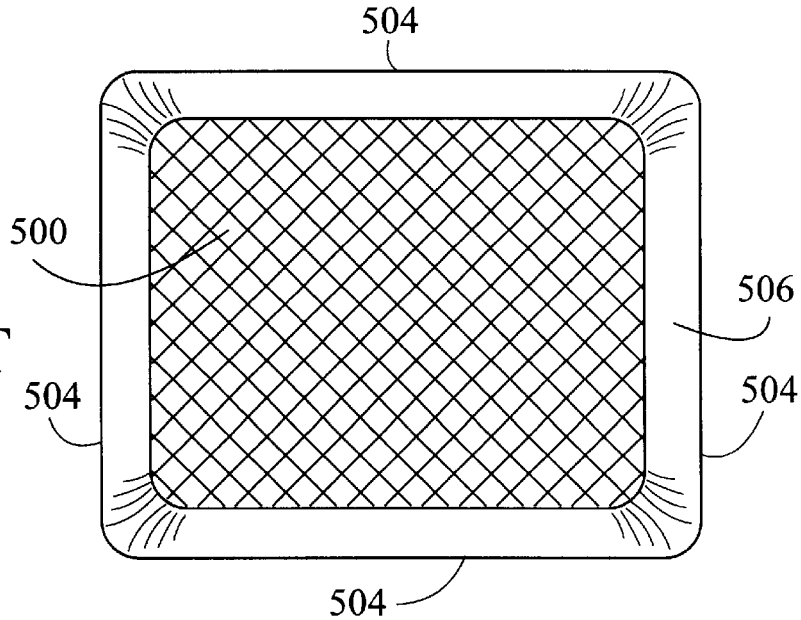
Fig. 3 PRIOR ART
FIG. 3 is a bottom plan view of the mattress.

FIG. 3 is a bottom plan view of mattress 500 showing fitted bottom bed covering 506.

Figure 4:
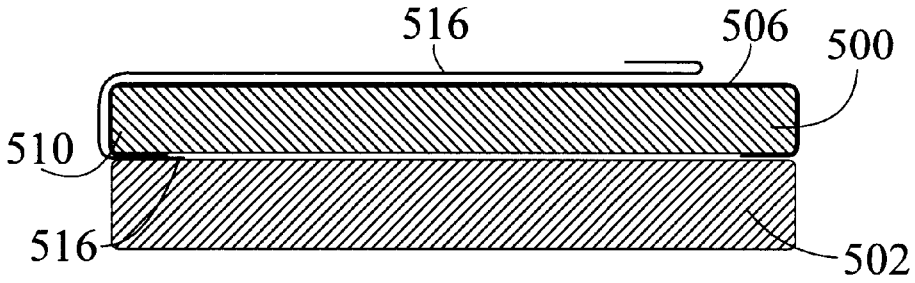
Fig. 4 PRIOR ART
FIG. 4 is a cross sectional view of the mattress and box spring showing a top bed covering.

FIG. 4 is a cross sectional view of mattress 500 and box spring 502 showing a top bed covering 516. Top bed covering 516 is typically a flat or fitted top sheet which is placed over the bottom bed covering 506 and tucked under the edge of mattress 500. When top bed covering 516 is installed on mattress 500, top bed covering 516 has a foot portion or area which resides on the underside of mattress 500 at the foot 510 of the bed. It is noted that, top bed covering 516 could also be a blanket, comforter, or the like.

Figure 5:
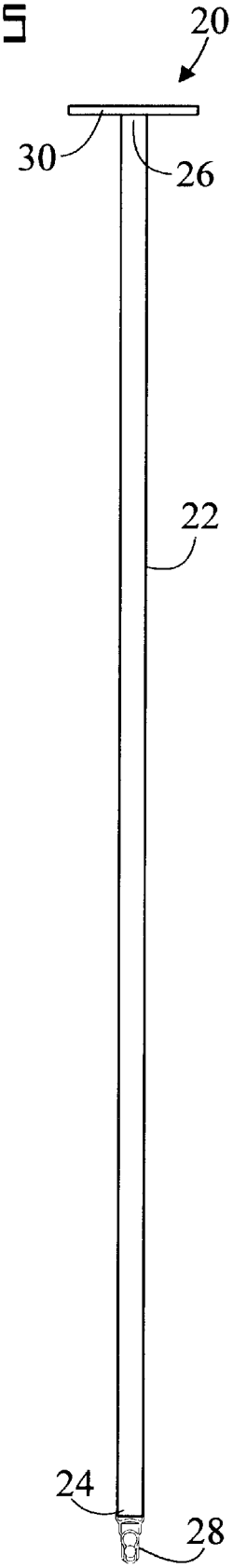
FIG. 5 is an enlarged top plan view of a device for attaching a bed covering to a bed in accordance with the present invention.

FIG. 5 is an enlarged top plan view of a device for attaching a bed covering to a bed in accordance with the present invention, generally designated as 20. Device 20 includes an elongated member 22 having a first end 24 and an opposite second end 26. In the shown preferred embodiment, elongated member 22 is a strap; however, it may be appreciated that elongated member 22 could also be a rope, wire, cable, cord, or the like. In a preferred embodiment, elongated member 22 is flexible. A connector 28 is attached to first end 24, the connector 28 being selectively attachable to a bed covering 506 or 516 (refer to FIG. 4). An anchor 30 is connected to second end 26 of elongated member 22. Elongated member 22 is connected to a central portion of anchor 30 (also refer to FIG. 9).

Figure 6:
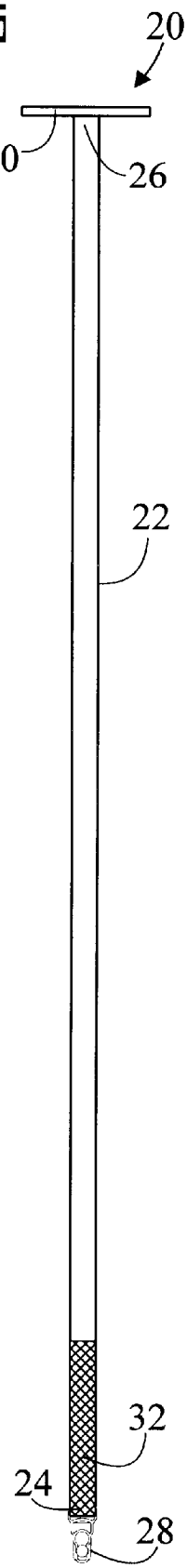
FIG. 6 is an enlarged top plan view of a variation of the device.

FIG. 6 is an enlarged top plan view of a variation of device 20. In this embodiment elongated member 22 is longitudinally stretchable. One manner of achieving this effect is to include an elastic portion 32.

Figure 7:
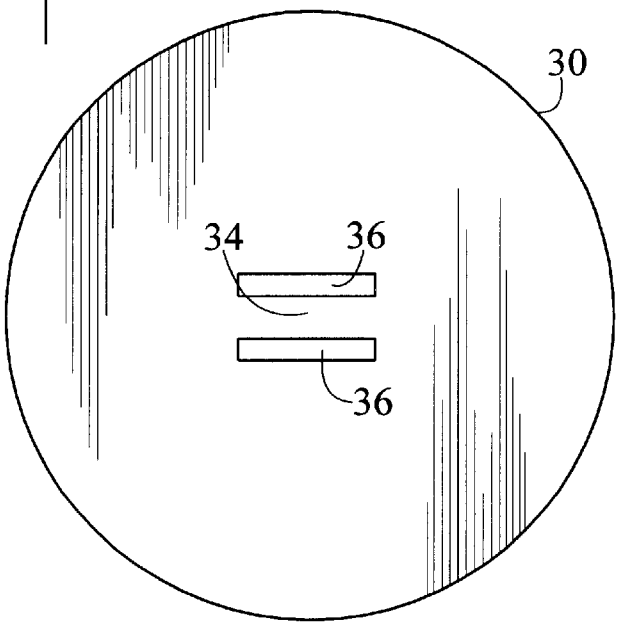
FIG. 7 is an enlarged side elevation view of an anchor.
Figure 8:
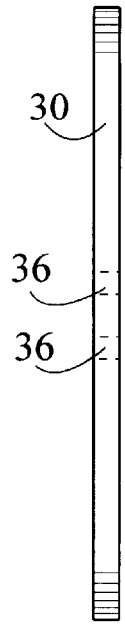
FIG. 8 is an enlarged end elevation view of the anchor.

FIGS. 7 and 8 are enlarged side elevation and end elevation views respectively of anchor 30. Anchor 30 is substantially planar, and has a central portion 34 which is connected to second end 26 of elongated member 22. Elongated member 22 passes through slits 36 to effect attachment of anchor 30 (refer also to FIG. 9). The central connection of elongated member 22 to anchor 30 ensures that anchor 30 will catch side walls 504 of both mattress 500 and box spring 502 (refer also to FIG. 14). In the shown preferred embodiment, anchor 30 is circular (disc-shaped); however, anchor 30 could also be oval, rectangular, triangular, x-shaped, or any other shape which can be lodged between mattress 500 and box spring 502 so that it captively abuts the side walls 504 of mattress 500 and box spring 502. In a preferred embodiment, anchor 30 is fabricated from a polymer; however, other ridged or semi-ridged materials could also be utilized.

Figure 9:
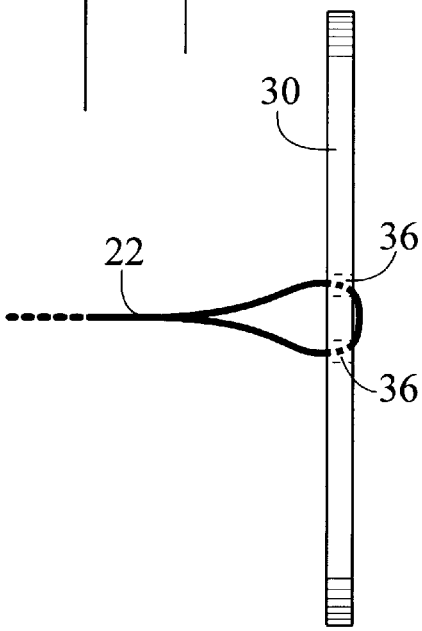
FIG. 9 is an enlarged end elevation view of the anchor connected to an elongated member.

FIG. 9 is an enlarged end elevation view of anchor 30 connected to elongated member 22. Elongated member 22 passes through slits 36 and is then attached to itself such as by stitching or clamping.

Figure 10:
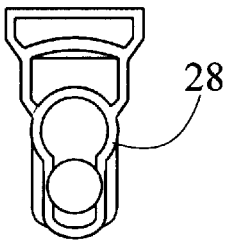
FIG. 10 is an enlarged top plan view of a connector.

FIG. 10 is an enlarged top plan view of connector 28. In the shown preferred embodiment, connector 28 is of the garter-type which is well known in the art. A captive flexible-tab, typically fabricated from rubber, captures and holds the bed coverings against a metal frame work. This type of connector has the advantage that it will not tear or penetrate the bed coverings. It may be appreciated however, that while the shown garter-type connector is preferred, other connectors such as suspender clamps, pins, Velcro, and the like could also be employed.

Figure 11:
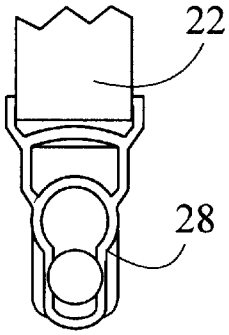
FIG. 11 is an enlarged top plan view of the connector attached to the elongated member.

FIG. 11 is an enlarged top plan view of connector 28 attached to elongated member 22.

Figure 12:
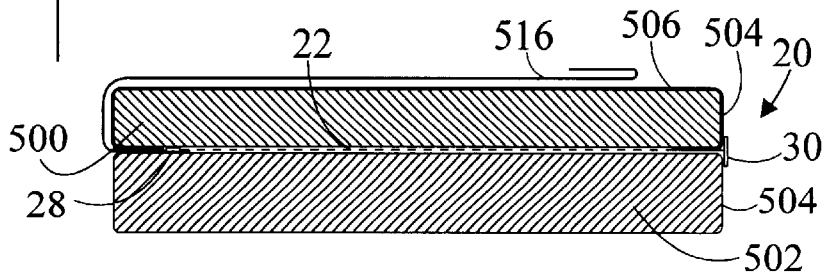
FIG. 12 is a cross sectional view of the device installed between the mattress and the box spring and attached to a top bed covering.
Figure 13:
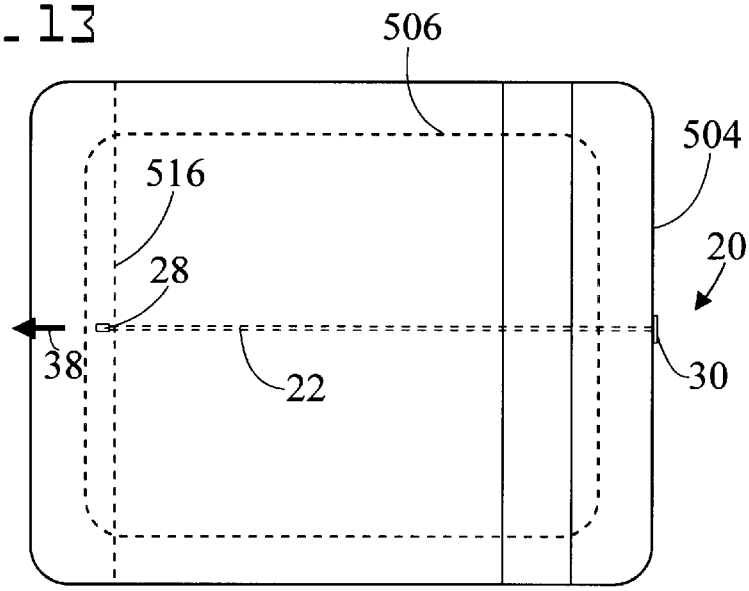
FIG. 13 is a top plan view of the device installed on the bed.

FIGS. 12 and 13 are cross sectional and top plan views respectively of device 20 installed on a bed between mattress 500 and box spring 502 with connector 28 attached to top bed covering 516. Elongated member 22 is disposed between mattress 500 and box spring 502 with connector 28 attached to a bed covering, such as top bed covering 516. Anchor 30 is positioned so that it simultaneously abuts side walls 504 of both mattress 500 and box spring 502, thereby restricting the bed covering 516 to move a maximum predetermined distance away from the side walls 504. Anchor 30 is captured by side walls 504, and once elongated member 28 is fully extended, bed covering 516 is prevented from moving further in direction 38, and thereby remains tucked under mattress 500. The length of elongated member 22 is selected to extend from side walls 504 across the bed and to the bed covering 506 or 516 on the opposite side of the bed.

Figure 14:
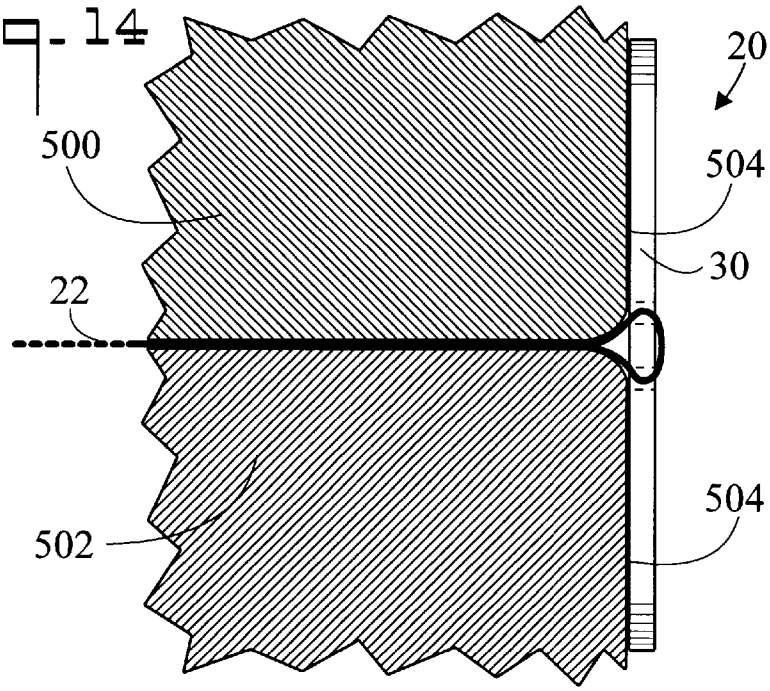
FIG. 14 is an enlarged end elevation view of the device installed on the bed.

FIG. 14 is an enlarged end elevation view of device 20 installed on the bed. Anchor 30 resides vertically and is captured by side walls 504 of mattress 500 and box spring 502.

In terms of use, a method for attaching a top bed covering 516 to a bed, includes:

(a) providing a bed having a mattress 500 disposed on top of a box spring 502, the mattress 500 and box spring 502 having adjacent side walls 504;

(b) providing a top bed covering 516;

(c) providing a device 20 for attaching a bed covering to a bed, the device 20 including:
an elongated member 22 having a first end 24 and an opposite second end 26;
a connector 28 attached to first end 24;
an anchor 30 connected to second end 26;

(d) positioning anchor 30 so that it simultaneously abuts the side walls 504 of both mattress 500 and box spring 502;

(e) positioning elongated member 22 between mattress 500 and box spring 502; and, (f) attaching connector 28 to top bed covering 516.

The method may further include:

in step (a), the bed having a head portion 508 and a foot portion 510;

in step (d), positioning anchor 30 so that it abuts side walls 504 of head portion 508 of the bed;

in step (f), attaching connector 28 to top bed covering 516 at the foot portion 510 of the bed.

Figure 15:
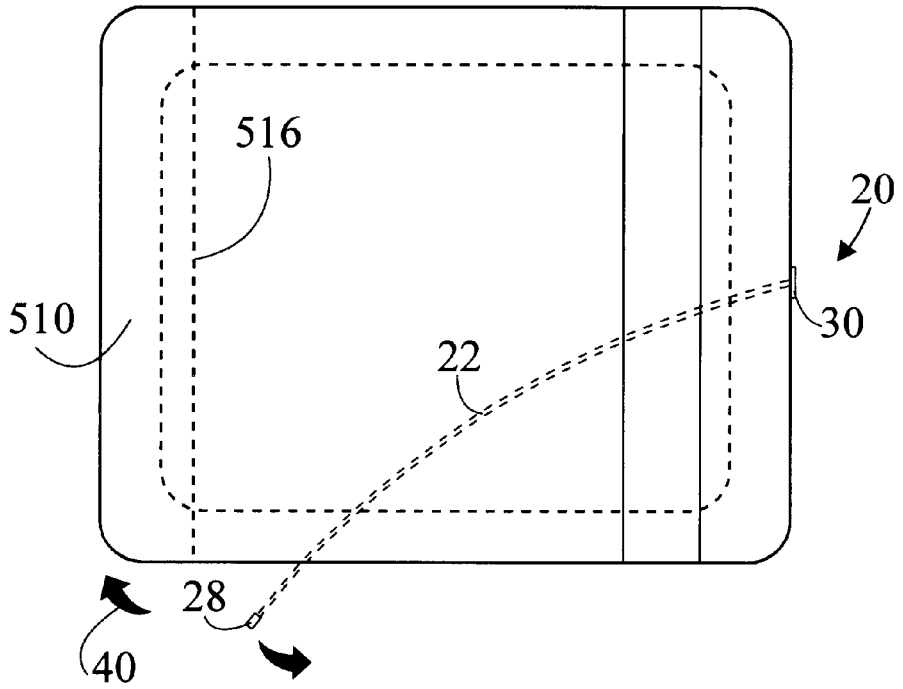
FIG. 15 is a top plan view of the connector and elongated member moved to a side of the bed.

FIG. 15 is a top plan view of connector 28 and elongated member 22 moved to a side of the bed (either left side 514 shown, or right side 512). In this fashion, connector 28 can be conveniently attached to top bed covering 516. To that end:

a method for attaching a-top bed covering 516 to a bed may further include:
in step (a), the bed having a side;
in steps (e) and (f);
moving elongated member 22 toward the side so that connector 28 hangs over the side;
attaching connector 28 to top bed covering 516; and, sliding top bed covering 516 in direction 40 until connector 28 is substantially centered upon foot portion 510 of the bed.

Figure 16:
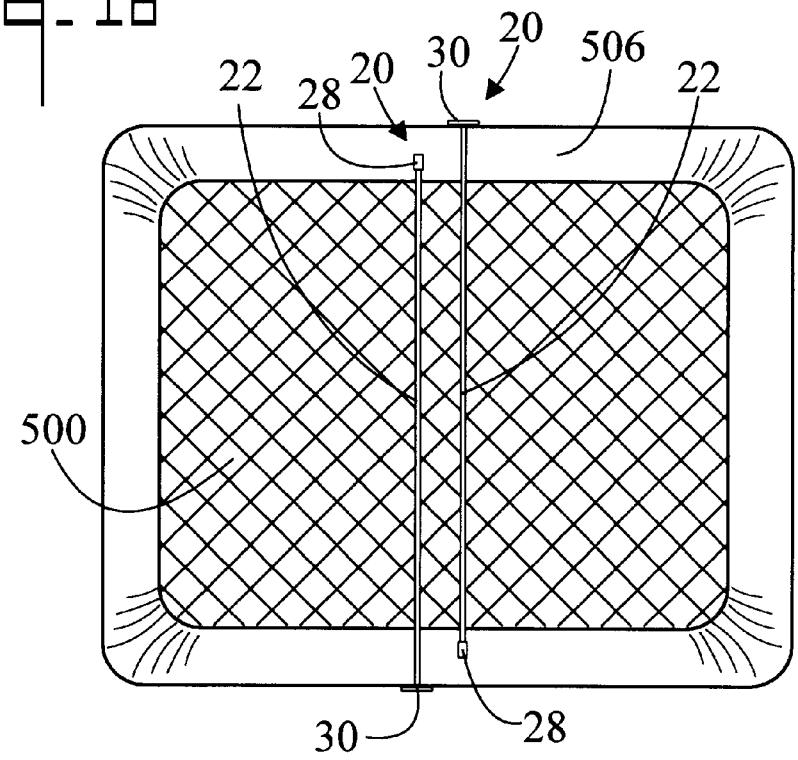
FIG. 16 is a bottom plan view of two parallel devices installed on the bed.
Figure 17:
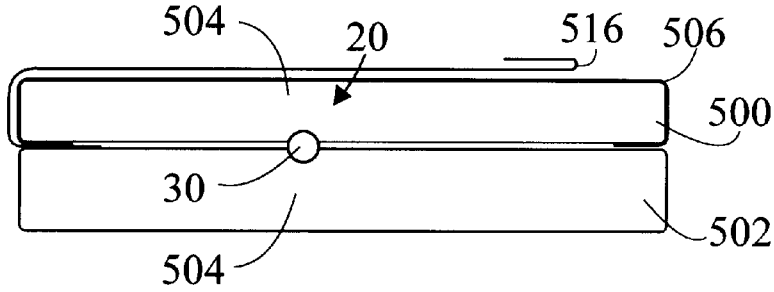
FIG. 17 is a side elevation view of the device installed on the side of the bed.

FIG. 16 is a bottom plan view of two parallel devices 20 installed on mattress 500 of the bed. And, FIG. 17 is a side elevation view of one of the devices 20 installed on the side of the bed. In this embodiment two parallel and opposite devices 20 may be used to secure bottom bed covering 506.

A method for attaching a bottom bed covering to a bed, includes:

(a) providing a bed having a mattress 500 disposed on top of a box spring 502, the mattress 500 and the box spring 502 having adjacent side walls 504, the bed having a right side 512 and an opposite left side 514;

(b) providing a bottom bed covering 506, the bottom bed covering fitted around mattress 500;

(c) providing first and second devices 20 for attaching a bed covering to a bed, the first and second devices 20 each including:
an elongated member 22 having a first end 24 and an opposite second end 26;
a connector 28 is attached to first end 24;
an anchor is connected to second end 26;

(d) positioning anchor 30 of first device 20 so that it simultaneously abuts side walls 504 of both mattress 500 and box spring 502 at right side 512 of the bed;

(e) positioning elongated member 22 of first device 20 between mattress 500 and box spring 502;

(f) attaching connector 28 of first device 20 to bottom bed covering 506 near left side 514 of the bed;

(g) positioning anchor 30 of second device 20 so that it simultaneously abuts side walls 504 of both mattress 500 and box spring 502 at left side 514 of the bed;

(h) positioning elongated member 22 of second device 20 between mattress 500 and box spring 502; and, (i) attaching connector 28 of second device 20 to bottom bed covering 506 near right side 512 of the bed.

The method may further include:

in steps (g), (h), and (i), positioning anchor 30 of second device 20, positioning elongated member 22 of second device 20, and attaching connector 28 of second device 20 so that elongated member 22 of first device 20 and elongated member 22 of second device 20 reside in adjacent and opposite parallel relationship.

Figure 18:
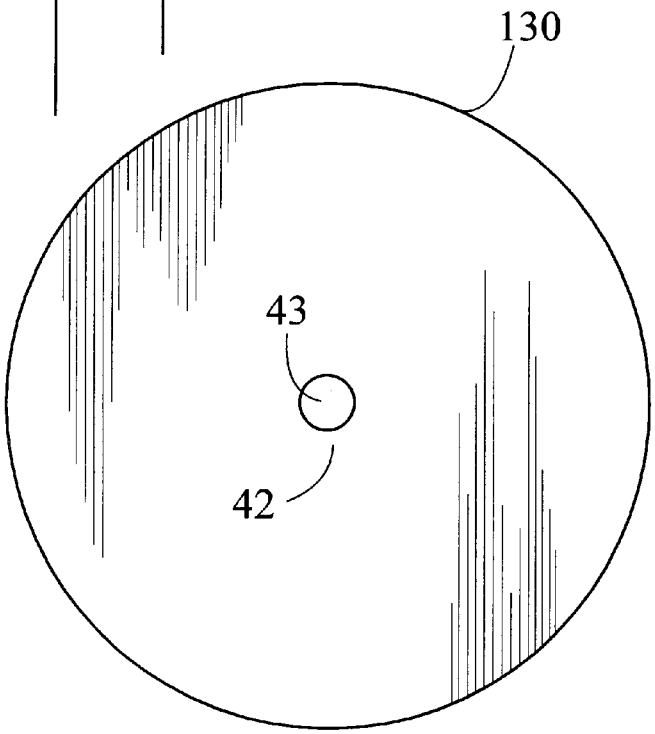
FIG. 18 is an enlarged side elevation view of a second embodiment of the anchor.
Figure 19:
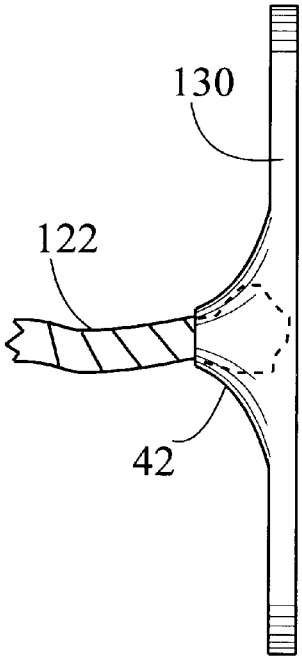
FIG. 19 is an enlarged end elevation view of the anchor of FIG. 18 attached to a rope.

FIG. 18 is an enlarged side elevation view of a second embodiment of anchor, generally designated as 130, and FIG. 19 is an enlarged end elevation view of anchor 130 attached to a rope. Anchor 130 includes a protruding central portion 42 directed toward mattress 500 and box spring 502. Protruding central portion 42 includes an hole 43. Protruding central portion 42 serves as a guide which enters the gap between mattress 500 and 502, thereby causing anchor 130 to come into abutting contact with side walls 504. In this embodiment, elongated member 122 consists of a rope which is feed through hole 43 and then knotted.

Figure 20:
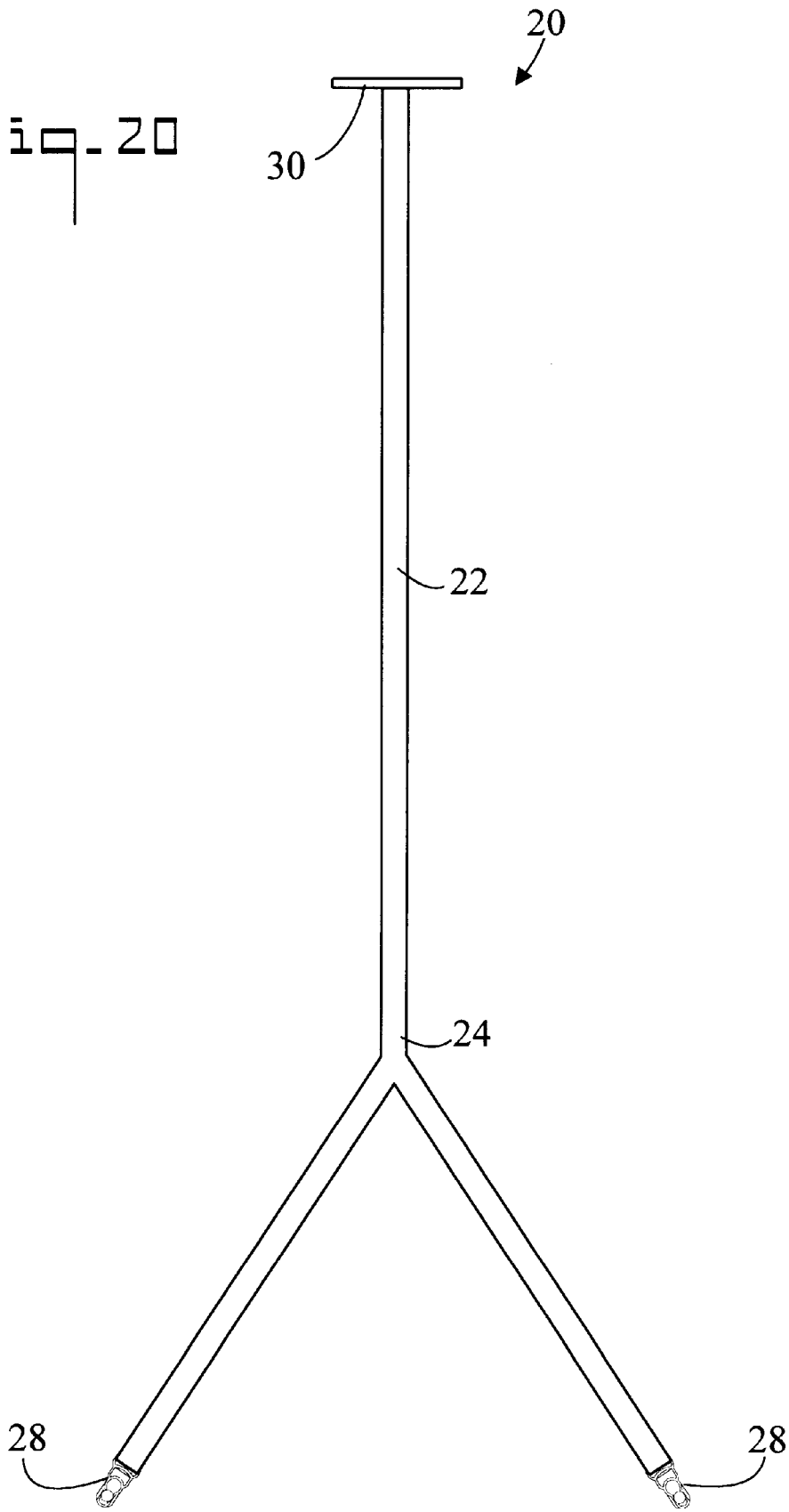
FIG. 20 is a top plan view of an embodiment of the device having two connectors.

FIG. 20 is a top plan view of an embodiment of device 20 having two connectors 28. In this embodiment, a second connector 28 is disposed at first end 24 of elongated member 24, the second connector 28 forming a "Y" with the connector 28. This embodiment may be utilized either to (1) attach a single bed covering a two places, or (2) to attach two bed coverings.

Figure 21:
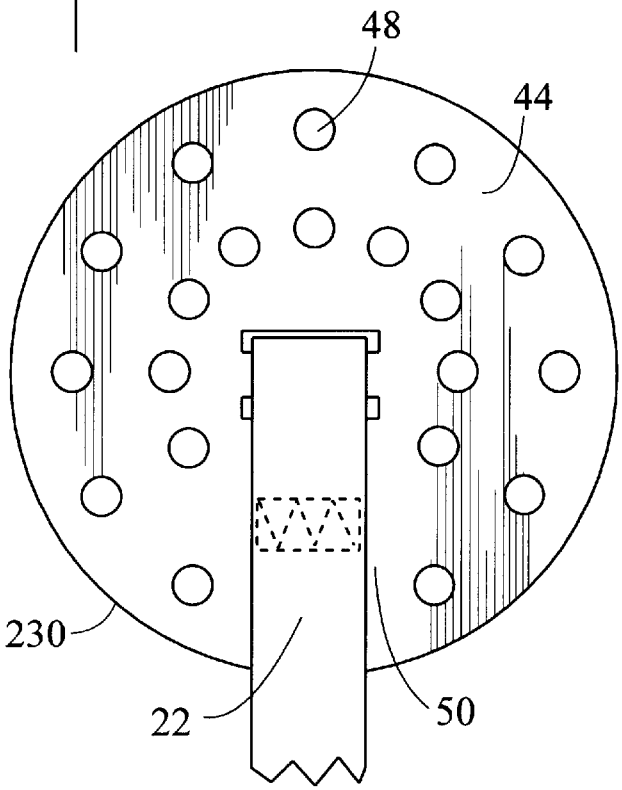
FIG. 21 is an enlarged side elevation view of a third embodiment of the anchor.
Figure 22:
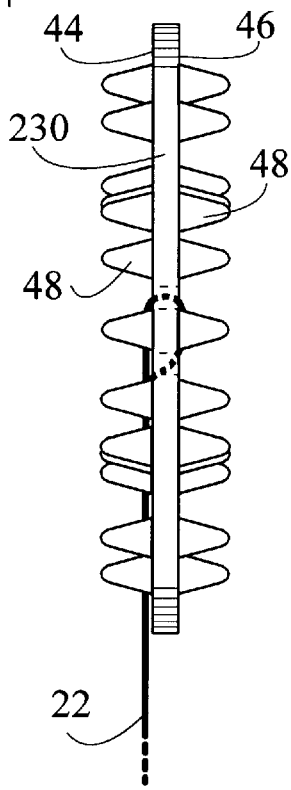
FIG. 22 is an enlarged end elevation view of the third embodiment of the anchor.

FIGS. 21 and 22 are enlarged side elevation and end elevation views respectively of a third embodiment the anchor, generally designated as 230. Anchor 230 has a first side 44 and an opposite second side 46. A plurality of nubs 48 are disposed upon at least one of first side 44 and second side 46 (on both sides in the shown preferred embodiment) However, nubs 48 could only be disposed on first side 44 with second side 46 being flat. Such a configuration would be useful with an air mattress which rests on a hard floor. The side having nubs 48, includes a nub-less swath 50 for carrying elongated member 22. That is, swath 50 is a clear area through which elongated member 22 may pass and lay substantially flat along the nubbed side. This is necessary because in this embodiment elongated member 22 is aligned parallel rather than perpendicular to anchor 230.

Figure 23:
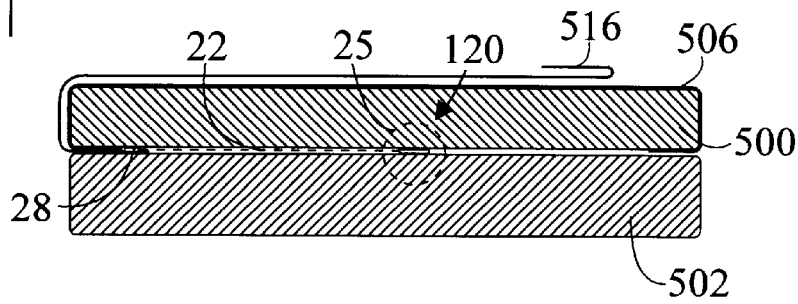
FIG. 23 is a cross sectional view of a second embodiment of the device installed on a bed.
Figure 24:
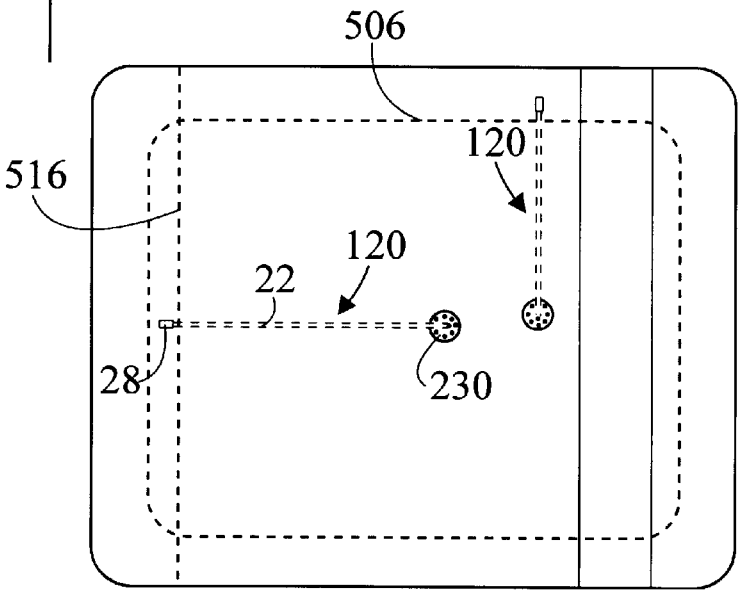
FIG. 24 is a top plan view of the second embodiment installed on a bed; and, FIG. 25 is an enlarged cross sectional view of area 25 of FIG. 23.

FIGS. 23 and 24 are cross sectional and top plan views respectively of a second embodiment of the device, generally designated as 120, installed on a bed. Anchor 230 is placed between mattress 500 and box spring 502 so that the weight of mattress 500 (and any bed occupants) causes protrusions 48 to dig into both mattress 500 and box spring 502 thereby holding anchor 230 in place. It is noted that anchor 230 resides in a substantially horizontal position. The horizontal embodiment could also be utilized with and air mattress which is placed upon a hard floor.

Figure 25:
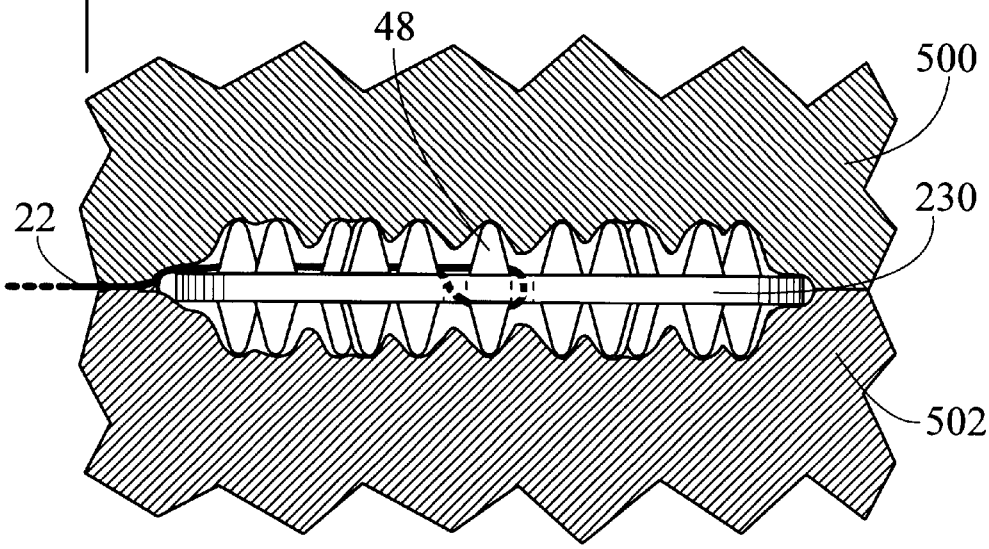

FIG. 25 is an enlarged cross sectional view of area 25 of FIG. 23, showing anchor 230 installed in a horizontal position between mattress 500 and box spring 502.

A method for attaching a top bed covering to a bed, includes:

(a) providing a bed having a mattress 500 disposed on top of a box spring 502;

(b) providing a top bed covering 516;

(c) providing a device 120 for attaching a bed covering to a bed, device 120 including:

an elongated member 22 having a first end 24 and an opposite second end 26;

a connector 28 attached to first end 24;

an anchor 230 connected to second end 26, anchor 30 having a first side 44 and an opposite second side 46;

a plurality of nubs 48 disposed upon at least one of first side 44 and second side 46;

(d) positioning anchor 230 between mattress 500 and box spring 502 so that nubs 48 abut at least one of the mattress 500 and the box spring 502;

(e) positioning elongated member 22 between mattress 500 and box spring 502; and, (e) attaching connector 28 to top bed covering 516.

It is noted that the embodiment shown in FIGS. 21 through 25 can also be utilized in the manner described for FIGS. 5–14.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method for attaching a top bed covering to a bed, comprising:

(a) providing a bed having a mattress disposed on top of a box spring, said mattress and box spring having adjacent side walls, said bed having a head portion and a foot portion;

(b) providing a top bed covering;

(c) providing a device for attaching a bed covering to a bed, said device including:

an elongated member having a first end and an opposite second end;

a connector attached to said first end;

an anchor connected to said second end;

(d) positioning said anchor so that it simultaneously abuts said side walls of both said mattress and said box spring at said head portion of said bed;

(e) positioning said elongated member between said mattress and said box spring;

(f) attaching said connector to said top bed covering at said foot portion of said bed;

in step (a), said bed having a side;

in steps (e) and (f);

moving said elongated member toward said side so that said connector hangs over said side;

attaching said connector to said top bed covering; and, sliding said top bed covering until said connector is substantially centered upon said foot portion of said bed.

2. A method for attaching a bottom bed covering to a bed, comprising:

(a) providing a bed having a mattress disposed on top of a box spring, said mattress and said box spring having adjacent side walls, said bed having a right side and an opposite left side;

(b) providing a bottom bed covering, said bottom bed covering fitted around said mattress;

(c) providing first and second devices for attaching a bed covering to a bed, said first and second devices each including:

an elongated member having a first end and an opposite second end;

a connector attached to said first end;

an anchor connected to said second end;

(d) positioning said anchor of said first device so that it simultaneously abuts said side walls of both said mattress and said box spring at said right side of said bed;

(e) positioning said elongated member of said first device between said mattress and said box spring;

(f) attaching said connector of said first device to said bottom bed covering near said left side of said bed;

(g) positioning said anchor of said second device so that it simultaneously abuts said side walls of both said mattress and said box spring at said left side of said bed;

(h) positioning said elongated member of said second device between said mattress and said box spring; and, (i) attaching said connector of said second device to said bottom bed covering near said right side of said bed.

3. The method of claim 2 further including:

in steps (g), (h), and (i), positioning said anchor of said second device, positioning said elongated member of said second device, and attaching said connector of said second device so that said elongated member of said first device and said elongated member of said second device reside in adjacent and opposite parallel relationship.

4. A device for attaching a bed covering to a bed, the bed having a mattress disposed on top of a box spring, the mattress and box spring having adjacent side walls, said device comprising:

an elongated member having a first end an opposite second end;

a connector attached to said first end, said connector attachable to a bed covering;

an anchor connected to said second end;

wherein said elongated member may be disposed between the mattress and the box spring with said connector attached to the bed covering;

wherein said anchor may be positioned so that it simultaneously abuts the side walls of both the mattress and the box spring, thereby restricting the bed covering to move a maximum predetermined distance away from the side walls; and, said connector being a garter connector.

* * * * *